US009259107B2

(12) United States Patent
Lilienthal

(10) Patent No.: US 9,259,107 B2
(45) Date of Patent: Feb. 16, 2016

(54) FITTED COVERING FOR A MATTRESS

(71) Applicant: TARGET BRANDS, INC., Minneapolis, MN (US)

(72) Inventor: Kate Lilienthal, St. Paul, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 42 days.

(21) Appl. No.: 13/791,038

(22) Filed: Mar. 8, 2013

(65) Prior Publication Data

US 2014/0109315 A1 Apr. 24, 2014

Related U.S. Application Data

(60) Provisional application No. 61/716,335, filed on Oct. 19, 2012.

(51) Int. Cl.

| | |
|---|---|
| ***A47G 9/04*** | (2006.01) |
| ***A47G 9/02*** | (2006.01) |
| ***A47C 31/10*** | (2006.01) |

(52) U.S. Cl.

CPC ..... *A47G 9/02* (2013.01); *A47C 31/105* (2013.01); *A47G 9/0246* (2013.01)

(58) Field of Classification Search

CPC ..... A47G 9/02; A47G 9/0246; A47G 9/0238; A47C 21/022; A47C 31/105

USPC ..... 5/495–499

See application file for complete search history.

(56) References Cited

U.S. PATENT DOCUMENTS

| | | | | | |
|---|---|---|---|---|---|
| 2,528,313 | A | * | 10/1950 | Kessler | 5/497 |
| 2,942,280 | A | * | 6/1960 | May, Jr. | 5/497 |
| 2,791,784 | A | | 5/1967 | Tomsic | |
| 4,662,013 | A | | 5/1987 | Harrison | |
| 4,703,530 | A | * | 11/1987 | Gusman | 5/497 |
| 4,768,252 | A | | 9/1988 | Ross | |
| 4,912,790 | A | | 4/1990 | MacDonald | |
| 4,970,744 | A | * | 11/1990 | Davis | 5/497 |
| 4,980,941 | A | | 1/1991 | Johnson, III | |
| 5,029,353 | A | | 7/1991 | Kimball et al. | |
| 5,479,664 | A | | 1/1996 | Hollander | |
| 5,513,403 | A | | 5/1996 | Wooten, Jr. | |
| 5,557,814 | A | * | 9/1996 | Cybulski | 5/496 |

(Continued)

OTHER PUBLICATIONS

Office Action from Canadian Patent Application No. 2,813,616, mailed Jul. 17, 2013 (2 pages).

(Continued)

*Primary Examiner* — David E Sosnowski

(74) *Attorney, Agent, or Firm* — Griffiths & Seaton PLLC; Joann M. Seaton

(57) ABSTRACT

A fitted covering for a mattress includes a body, a peripheral elastic cord, and corner elastic bands. The body includes an upper panel and a side skirt extending outwardly away from the upper panel to define a free edge opposite the upper panel. The upper panel defines corners, and the side skirt defines corner lines each extending away from one of the corners of the upper panel. The peripheral elastic cord is coupled to and extends substantially coextensively with the free edge. The corner elastic bands are each formed separately from one another. The corner elastic bands each extend substantially transversely across and secured to a corresponding one of the corner lines of the side skirt. Each of the corner elastic bands is positioned nearer the peripheral elastic cord than the upper panel.

23 Claims, 18 Drawing Sheets

(56) References Cited

U.S. PATENT DOCUMENTS

| | | | | |
|---|---|---|---|---|
| 5,625,912 | A | 5/1997 | McCain et al. | |
| 5,729,847 | A | 3/1998 | Allardice | |
| 6,353,947 | B1 * | 3/2002 | McCain et al. | 5/500 |
| 6,983,500 | B2 * | 1/2006 | Wootten | 5/497 |
| 7,032,262 | B2 | 4/2006 | Creech | |
| 7,131,152 | B2 * | 11/2006 | Wootten et al. | 5/485 |
| 7,150,055 | B2 | 12/2006 | Wootten, Jr. | |
| 7,316,039 | B2 | 1/2008 | Wootten, Jr. | |
| 7,530,124 | B1 | 5/2009 | Wootten, Jr. | |
| 7,562,404 | B2 | 7/2009 | Wootten, Jr. | |
| 7,565,707 | B2 | 7/2009 | Wootten, Jr. | |
| 7,698,758 | B2 | 4/2010 | Wootten, Jr. | |
| 2004/0040090 | A1 | 3/2004 | Wootten | |
| 2004/0187211 | A1 * | 9/2004 | Wootten, Jr. | 5/497 |
| 2005/0011007 | A1 | 1/2005 | Lintner | |
| 2009/0205134 | A1 | 8/2009 | Wootten, Jr. | |

OTHER PUBLICATIONS

Wamsutta Fitted Sheet with Staymade™ Corner (admitted prior art) (1 page).

"The DreamFit™ Bed Sheet", printed from http://deepfitsheets.com/, available as early as Feb. 22, 2012 per http://web.archive.org (1 page).

* cited by examiner

FITTED COVERING FOR A MATTRESS

CROSS-REFERENCE TO RELATED APPLICATION

This application is a non-provisional application of and claims priority under 35 U.S.C. §119(e) to U.S. Provisional Patent Application No. 61/716,335, filed Oct. 19, 2012, which is incorporated herein by reference.

BACKGROUND OF THE INVENTION

Fitted sheets and mattress pads are commonly used and available to accommodate various sizes of mattresses (e.g., twin, full, queen, king). Many mattress coverings are formed of one or more pieces of generally inelastic fabric formed to fit over a top surface, side surfaces, and a portion of a bottom surface of a mattress or similar structure. An elastic band extends around a lower edge or periphery of the covering to hold the covering in place around the mattress. The inelastic nature of the fabric does not generally lend itself to accommodating various thicknesses (e.g., heights) of mattress in a consistently secure manner.

SUMMARY OF THE INVENTION

One aspect of the present invention relates to a fitted covering for a mattress. The fitted covering includes a body, a peripheral elastic cord, and corner elastic bands. The body includes an upper panel and a side skirt extending outwardly away from the upper panel to define a free edge opposite the upper panel. The upper panel defines corners, and the side skirt defines corner lines each extending away from one of the corners of the upper panel. The peripheral elastic cord is coupled to and extends substantially coextensively with the free edge. The corner elastic bands are each formed separately from one another. The corner elastic bands each extend substantially transversely across and are secured to a corresponding one of the corner lines of the side skirt. Each of the corner elastic bands is positioned nearer the peripheral elastic cord than the upper panel. Other apparatus, assemblies, and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

Figure 1:
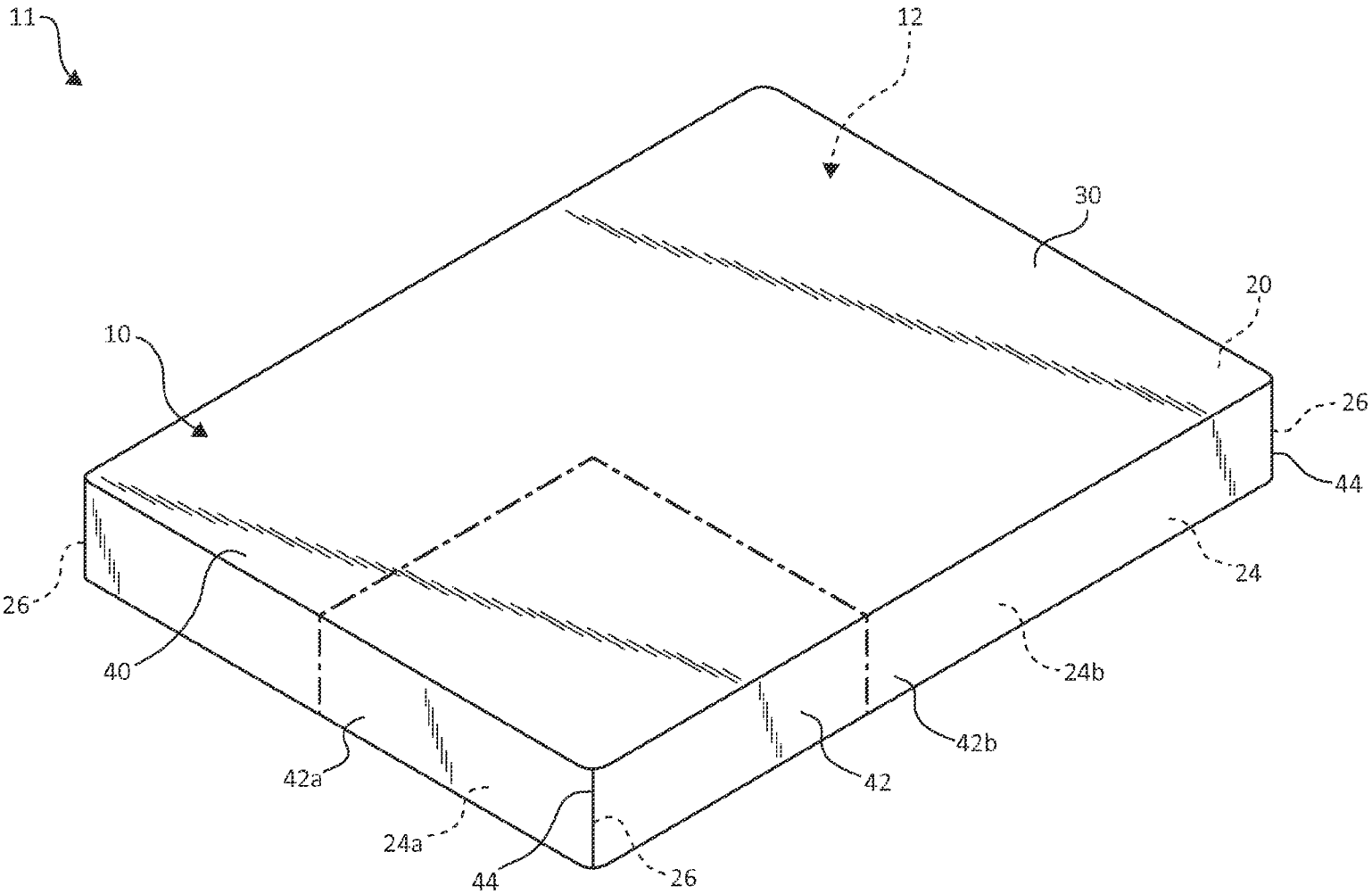
FIG. 1 is a top, front perspective view illustration of a covered mattress system including a mattress and a fitted covering, according to one embodiment of the present invention.

While fitted coverings such as fitted sheets and mattress pads for mattresses have commonly been sold in various sizes to accommodate beds of differing widths, for example, twin, double, full, queen, king, and western or California king, fitted coverings are not generally sold in various configurations based on a height or thickness of a mattress. Mattress thickness can vary greatly depending upon mattress attributes (e.g., pillow top, spring type, and other construction particulars), and for example, vary from between about 9 inches to about 20 inches or cover an even wider range of thicknesses. With this invention, a fitted covering is configured to provide a more secure fit of a fitted covering over mattresses of various thicknesses. More particularly, corner elastic band strips are secured to a body of the fitted covering radially outward from a bottom periphery elastic band strip of the fitted covering to provide additional securement of the fitted covering to the mattress.

Turning to the Figures, FIGS. 1-8 illustrate a covered mattress system 11 including a fitted covering 10 secured over a first mattress 12, and FIGS. 9-16 illustrate a covered mattress system 13 including the same fitted covering 10 over a second mattress 14, where second mattress 14 is considerably thicker than first mattress 12. Fitted covering 10 is, in one example, one of a fitted sheet and a mattress pad configured for snug securement over mattresses, such as first mattress 12 and second mattress 14. Each of first mattress 12 and second mattress 14, as well as other mattresses, generally defines an upper face 20, a lower face 22 opposite upper face 20, and side faces 24 extending between and substantially perpendicularly to upper face 20 and lower face 22 (notably, upper face 20 and side faces 24 of each of first mattress 12 and second mattress 14 and various other features of first and second mattresses 12 and 14 are generally indicated through fitted covering 10 in FIGS. 1-16 as indicated by the dashed leader lines to the respective reference numbers). More particularly, side faces 24 of each of first mattress 12 and second mattress 14 include two opposing lateral side faces 24*a* and two opposing longitudinal side faces 24*b*, which intersect to form corners 26 transversely extending between corners of upper face 20 and lower face 22.

Fitted covering 10 is configured to selectively be disposed over either one of first mattress 12 and second mattress 14, covering upper face 20, side faces 24, and a portion of lower face 22 thereof. Fitted covering 10 is illustrated alone without one of first mattress 12 and second mattress 14 in FIG. 17. Fitted covering 10 includes a body 30, a peripheral elastic band 32, and corner elastic bands 34. In one example, body 30 is partially or wholly formed of a generally inelastic material such as cotton, cotton blend, satin, or other suitable material. Body 30 includes a primary planar portion or upper panel 40 and side panels 42 (collectively defining a side skirt), according to one embodiment. Upper panel 40 is substantially rectangular having four corners and is sized to cover a substantial entirety of upper face 20 of one of first mattress 12 and second mattress 14. For example, the length and width of upper panel 40 corresponds to a standard mattress size, e.g., twin, full, queen, or western or California king.

Side panels 42 may be formed integrally with or as separate pieces secured to upper panel 40. Each side panel 42 extends away from a substantially linear peripheral segment of upper panel 40. In one embodiment, linear, free ends 52 of adjacent side panels 42 are sewn together to form a corner seam 44 extending substantially traverse to upper panel 40 when fitted covering 10 is disposed on one of first and second mattresses 12 or 14. When four corner seams 44 are formed, side panels 42 collectively extend substantially entirely around an outer perimeter of upper panel 40.

Side panels 42 extend from upper panel 40 to terminate in a closed loop binding 46 opposite upper panel 40 defining an opening 48 bounded by closed loop binding 46. Closed loop binding 46 securely maintains, e.g., encompasses, peripheral elastic cord or band 32 to facilitate retention of fitted covering 10 on mattresses. Peripheral elastic band 32 is formed as a closed loop (e.g., ends are positioned adjacent and/or are otherwise secured to one another) and, in one example, extends through a substantially entirety of closed loop binding 44 and around opening 48.

In order to facilitate securement of fitted covering 10 to a mattress even where side panels 42 extending from upper panel 40 to closed loop binding 44 are inelastic, fitted covering 10 includes at least two and preferably four discrete corner elastic bands 34 each secured across a corner seam 44 of body 30. More specifically, as generally indicated in FIGS. 2, 8, 10, 16, 17, 18, and 24, a center or near a center 34*c* of an elongated piece of elastic band forming one of corner elastic bands 34 is positioned on a corresponding one of corner seams 44 in a position spaced radially outwardly from closed loop binding 46, but generally closer to closed loop binding 46 than upper panel 40 (e.g., in a lower half, and in one embodiment, in a lower third, of side panels 42). Corner elastic band 34 extends outwardly in opposite directions from and substantially transverse to corner seam 44 to define a first elastic band side or segment 34*a* and a second corner elastic band side or segment 34*b* (see FIGS. 18 and 24). Each of first elastic band segment 34*a* and second elastic band segment 34*b* extends beyond a different side of corner seam 44 to define an angle A between corner seam 44 and the respective one of first elastic band segment 34*a* and second elastic band segment 34*b* as shown in the detail view of FIG. 18 of about 45 degrees, or at an angle of between about 35 degrees and about 55 degrees.

Figure 18:
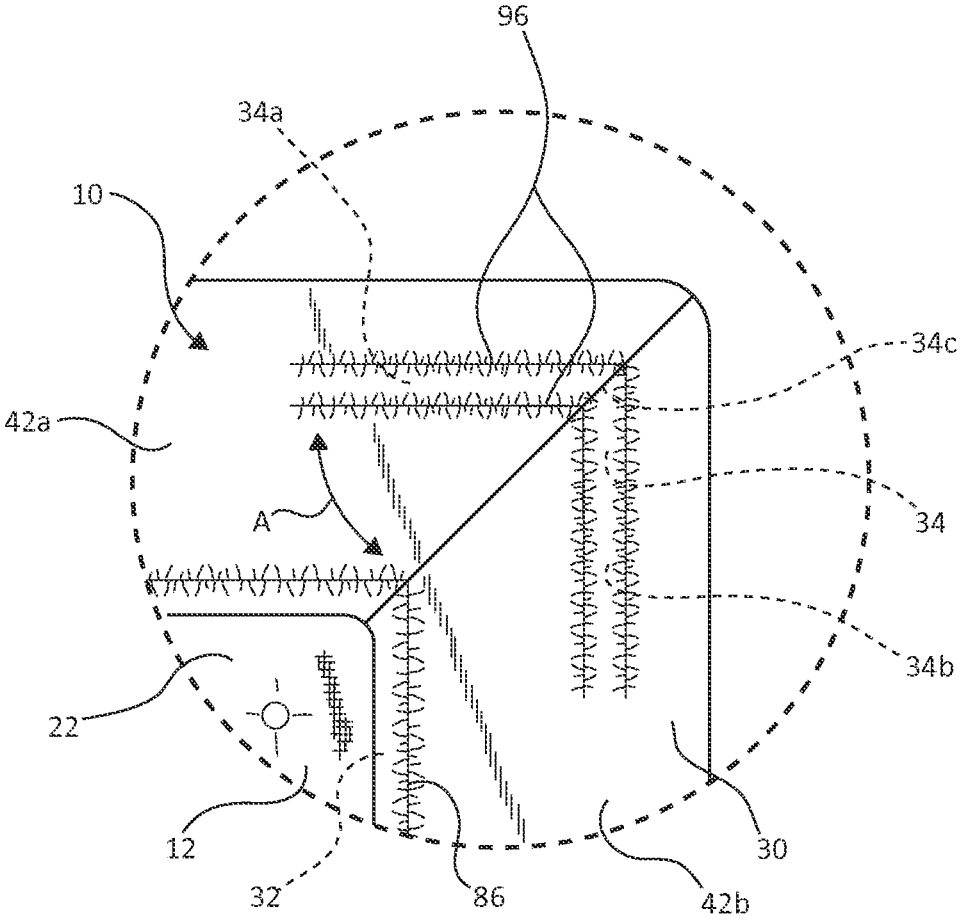
FIG. 18 is detailed view illustration of a corner of the covered mattress system of FIG. 8 as indicated by dashed circle D, according to one embodiment of the present invention.

As illustrated in FIG. 18, each corner elastic band 34, which is generally indicated with a broken leader line as it is positioned below the lateral side panel 42 in FIG. 18 with stitch lines 96 on either side of corner elastic band 34 also being illustrated, is separate from the other ones of corner elastic bands 34. First corner elastic band segment 34*a* extends across and is secured to a lateral side panel 42*a*, and second corner elastic band segment 34*b* extends across and is secured to a longitudinal side panel 42*b*. In one embodiment, each of first corner elastic band segment 34*a* and second corner elastic band segment 34*b* is linearly angled and/or curves at least slightly toward closed loop binding 46 as it nears an end thereof opposite corner seam 44.

When fitted covering 10 is disposed on first mattress 12 as illustrated in FIGS. 1-8, upper panel 40 of fitted covering 10 overlays upper face 20 of first mattress 12, corner seams 44 of fitted covering 10, at least upper portions thereof, overlay corners 26 of first mattress 12. A lower portion of each side panel 42 extends under lower face 22 radially extending inwardly from side faces 24 of first mattress 12 effectively forming an under skirt portion 50*a* including corner elastic bands 34. In this embodiment, corner elastic bands 34 provide additional tension to under skirt portion 50*a*, which further secures fitted covering over first mattress 12 in addition to peripheral elastic band 32. Notably, mattress 12 has a thickness toward the lower end of a range of mattress thicknesses typically available. For example, mattresses generally have a thickness in the range of about 8 inches to about 20 inches, and mattress 12 has a thickness of about 10 inches. In this case, corner elastic bands 34 securely hold fitted covering 10 under mattress 12, including managing excess fabric of fitted covering 10, and serve to more tautly hold the excess fabric extending under mattress 12 in a neat and secure manner. Accordingly, inadvertent shifting of under skirt portion 50*a*, such as excess fabric or other portions of under skirt portion 50*a* moving upwardly from lower face 22 of first mattress 12, is substantially prevented (e.g., prevented or at least largely decreased), thereby maintaining the neat appearance of fitted covering 10 around side faces 24 of first mattress 12.

FIGS. 9-16 illustrate fitted covering 10 disposed on second mattress 14, which is nearer an upper end of a range of mattress thicknesses, e.g., having a thickness of about 15 inches. As illustrated, upper panel 40 of fitted covering 10 overlays upper face 20 of second mattress 14, and corner seams 44 of fitted covering 10, at least upper portions thereof, overlay corners 26 of second mattress 14. A lower portion of each side panel 42 extends under lower face 22 radially inwardly from side faces 24 of second mattress 14 effectively forming an under skirt portion 50*b* that does not generally include corner elastic bands 34 and is substantially smaller than under skirt portion 50*a*. In this embodiment, corner elastic bands 34 each extend over adjacent ones of lateral side faces 24*a* and longitudinal side faces 24*b* effectively gripping side panels 42 across corner seam 44 and pulling side panels 42 taut over side faces 24. The securement of fitted covering 10 over side faces 24 of second mattress 14 substantially prevents (e.g., prevents or at least largely decreases) inadvertent shifting of fitted covering 10 upwardly toward upper panel 40 of fitted covering 10, thereby maintaining the neat appearance of fitted covering 10 around side faces 24 of second mattress 14.

In view of the above description, fitted covering 10 is provided in a variety of sizes based on the size of upper face 20 of mattresses, for example, twin, full, queen, king, and western or California king, but is provided in a single side panel 42 configuration to provide additional securement beyond peripheral elastic band 32 for a range of available mattress thicknesses. In one embodiment, fitted covering 10 is configured to provide corner elastic bands 34 to fit adjacent lower face 22 of mattresses, such as first mattress 12, having a thickness at a lower end of generally available thicknesses (e.g., a thickness of less than about 10.5 inches) and fitting above lower face 22 and adjacent side faces 24 of mattresses, such as second mattress 14, having a thickness at a higher end of generally available thicknesses (e.g., a thickness of more than about 10.5 inches). As such, fitted covering 10 is configured to adaptably receive and additionally secure to mattresses of various sizes.

Figure 19:
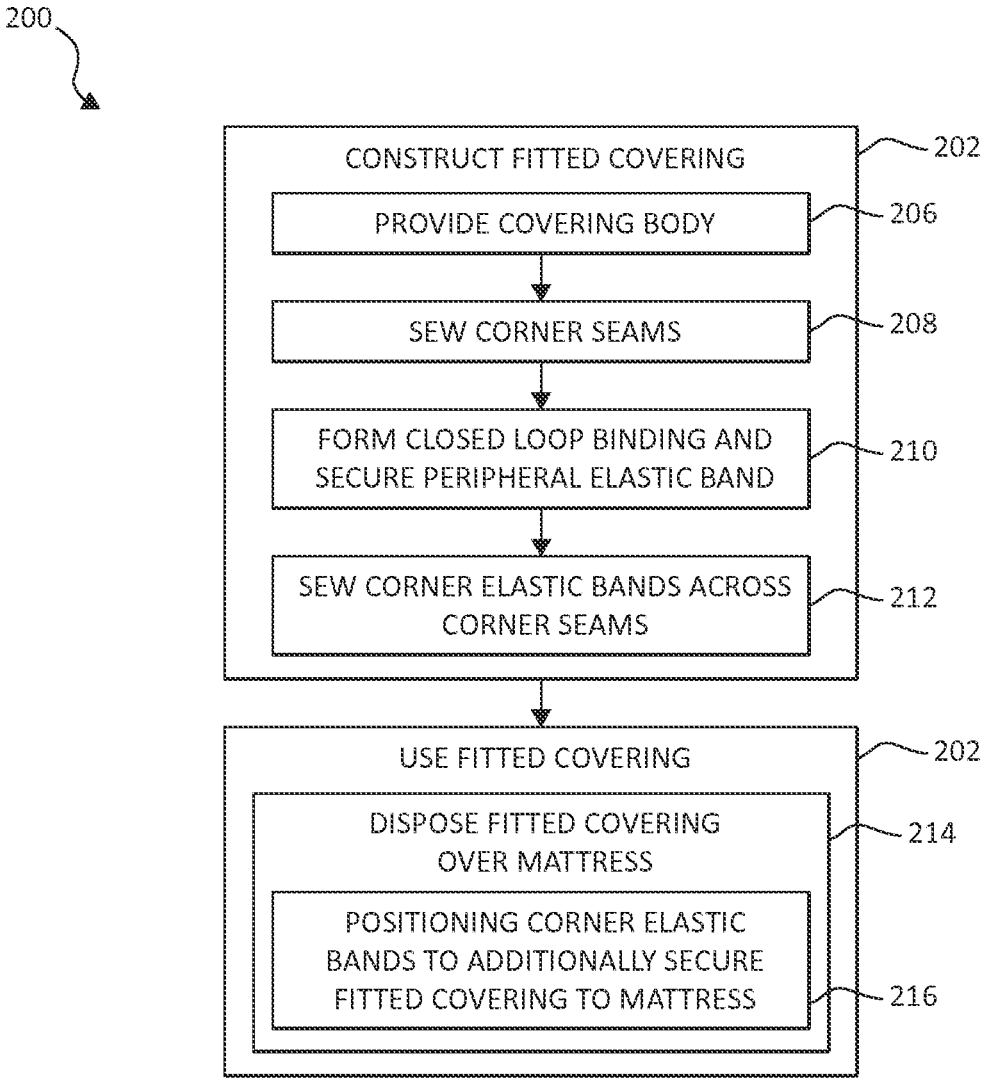
FIG. 19 is a flow chart illustrating a method of constructing a fitted covering, according to one embodiment of the present invention.

FIG. 19 is a flow chart illustrating one embodiment of a method 200 of constructing and using fitted covering 10 according to one embodiment of the invention as described with additional reference to at least FIGS. 20-25. Method 200 includes constructing fitted covering 10 at 202 followed by using fitted covering 10 at 204.

Figure 20:
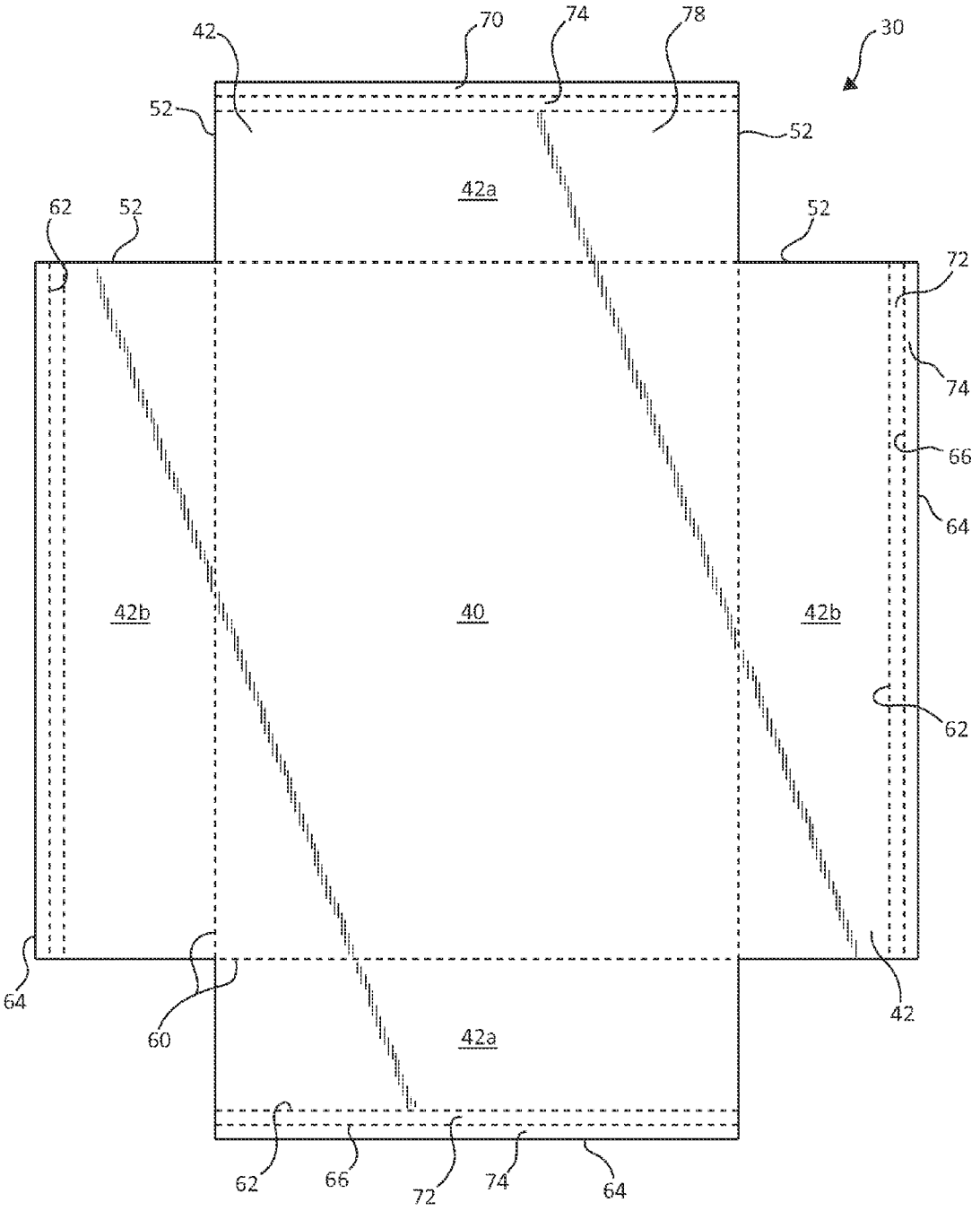
FIG. 20 is top view illustration of a fabric blank of the fitted covering of FIG. 17, according to one embodiment of the present invention.

Constructing fitted covering at 202 includes providing covering body 30 as illustrated for example with reference to FIG. 20. As illustrated, covering body 30 is formed of a single piece of material defining upper panel 40 and side panels 42. In other embodiments, one or more of side panels 42 may be formed separately from upper panel 40 and sewn or otherwise suitably coupled with upper panel 40. Upper panel 40 is sized according to a particular size mattress (e.g., twin, full, queen, king, or western California king) that fitted covering 10 is configured to cover and is bound by fold lines 60 each extending one of laterally and longitudinally to define a boundary between upper panel 40 and one of side panels 42. Each side panel 42 has one of a length or a width equal to a corresponding dimension of upper panel 40 and extends outwardly therefrom. Each side panel 42 is sized to at least cover a corresponding side face 24 (see, e.g., FIG. 1) and a portion of a lower face 22 of a mattress having a height or thickness within typical ranges, e.g., having a thickness of up to 20 inches or more, and to define closed loop binding 46.

Figure 21:
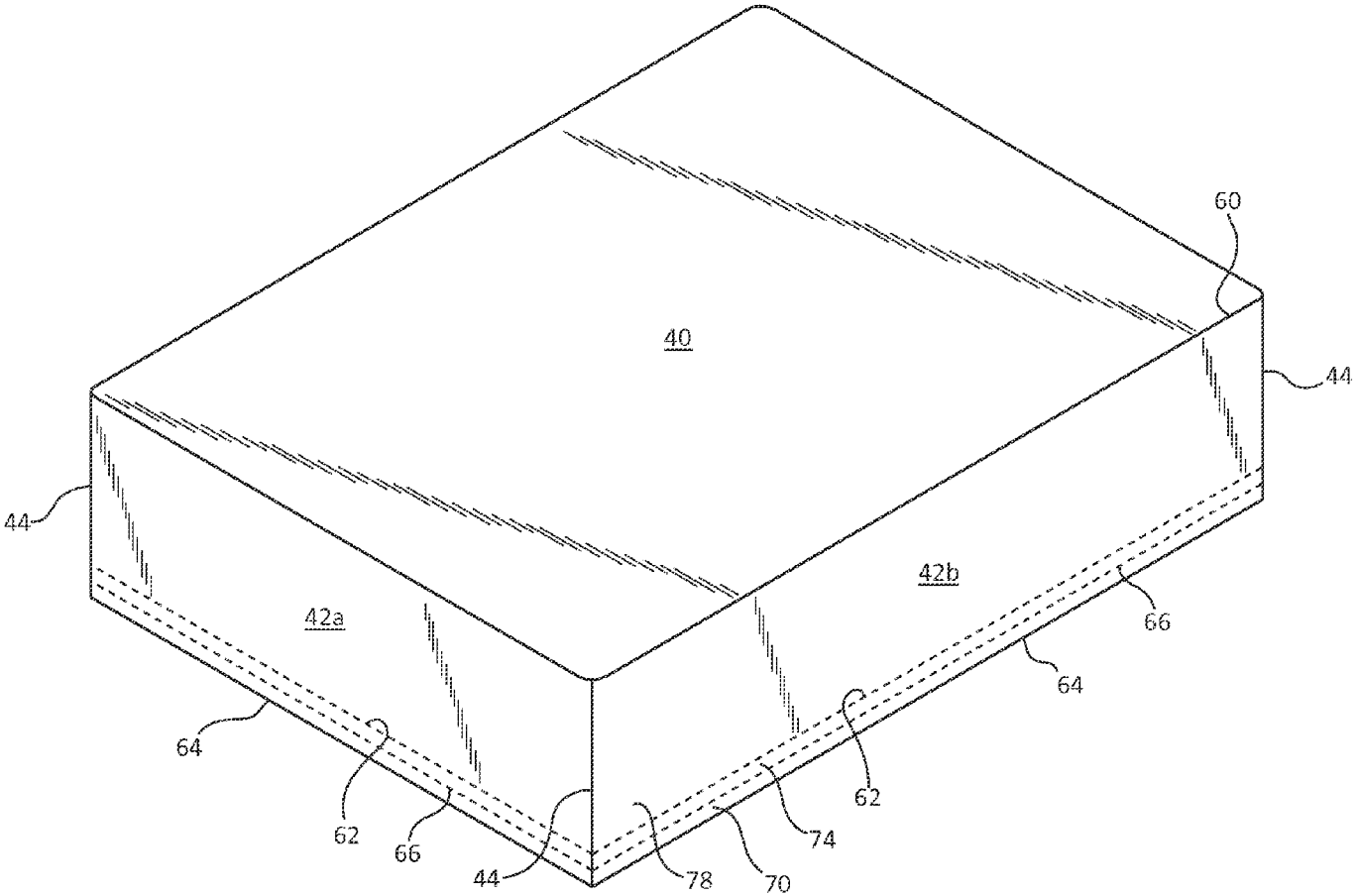
FIG. 21 is a top, front perspective view illustration of a partially constructed fabric blank of the fitted covering of FIG. 21, according to one embodiment of the present invention.

At 208, corner seams 44 are sewn or otherwise suitably created by coupling free ends 52 of side panels 42 extending substantially perpendicularly relative to corresponding fold lines 60 to adjacent free ends 52. More specifically, in one embodiment, one free end 52 of a lateral side panel 42*a* is coupled to one free end 52 of a longitudinal side panel 42*b* to form one corner seam 44, and so on such that when sewn to one another, side panels 42 collectively substantially entirely surround upper planar panel 40 as a side skirt as illustrated in FIG. 21. In one embodiment, the resultant corner seams 44 are each substantially linear and extend substantially perpendicularly to upper planar panel 40 of body 30. Notably, corner seam 44 demarks a corner line or intersection between side panels 42. While primarily described herein as corner seam 44, in other embodiments, such as where the side skirt is formed as a single piece of material, no corner seams 44 exist. In such embodiments, it will be understood that a no-seamed corner line will still exist in a similar position, that is, at an intersection between one lateral side panel 42*a* and one longitudinal side panel 42*b*, and that descriptions herein regarding locations of elements relative to one or more corner seams 44 would still hold true for non-seamed corner lines.

At 210, closed loop binding 46 is formed in a manner configured to secure peripheral elastic band 32 therein. For example, peripheral elastic band 32 has a substantially flat or rectangular cross section and defines a first elongated edge 80 opposite a second elongated edge 82. As illustrated with reference to FIGS. 21 and 22, in one embodiment, peripheral elastic band 32 is placed against an internal surface of body 30 in a manner positioning portions of first elongated edge 80 to coextend and be positioned directly adjacent to each of free edges 64 of each of side panels 42. In one embodiment, first elongated edge 80 of peripheral elastic band 32 is secured to all free edges 64 of side panels 42, for example using an overlock or other suitable stitch 84. Once free edges 64 are secured to first elongated edge 80, a first portion 70 of each side panel 42 extends from a respective free edge 64 directly adjacent and substantially parallel to a first surface 72 of peripheral elastic band 34 to first fold line 66.

Each side panel 42 is folded substantially 180 degrees along fold line 66, which is spaced from a corresponding free edge 64 a distance substantially equal and just slightly larger than a distance between first elongated edge 80 and second elongated edge 82 of peripheral elastic band 32. As such, a second portion 74 of each side panel 42 extends from fold line 66 to fold line 62 and is positioned directly adjacent and substantially parallel to an opposing and second surface 76 of peripheral elastic band 32. When so folded, bottom fold line 62 is positioned just below first elongated edge 80 of peripheral elastic band 32. Side panels 42 are folded upwardly substantially 180 degrees about fold line 62 such that a third portion 78 of each side panel 42 extends directly adjacent and substantially parallel to first portion 70 opposite peripheral elastic band 32.

Figure 2:
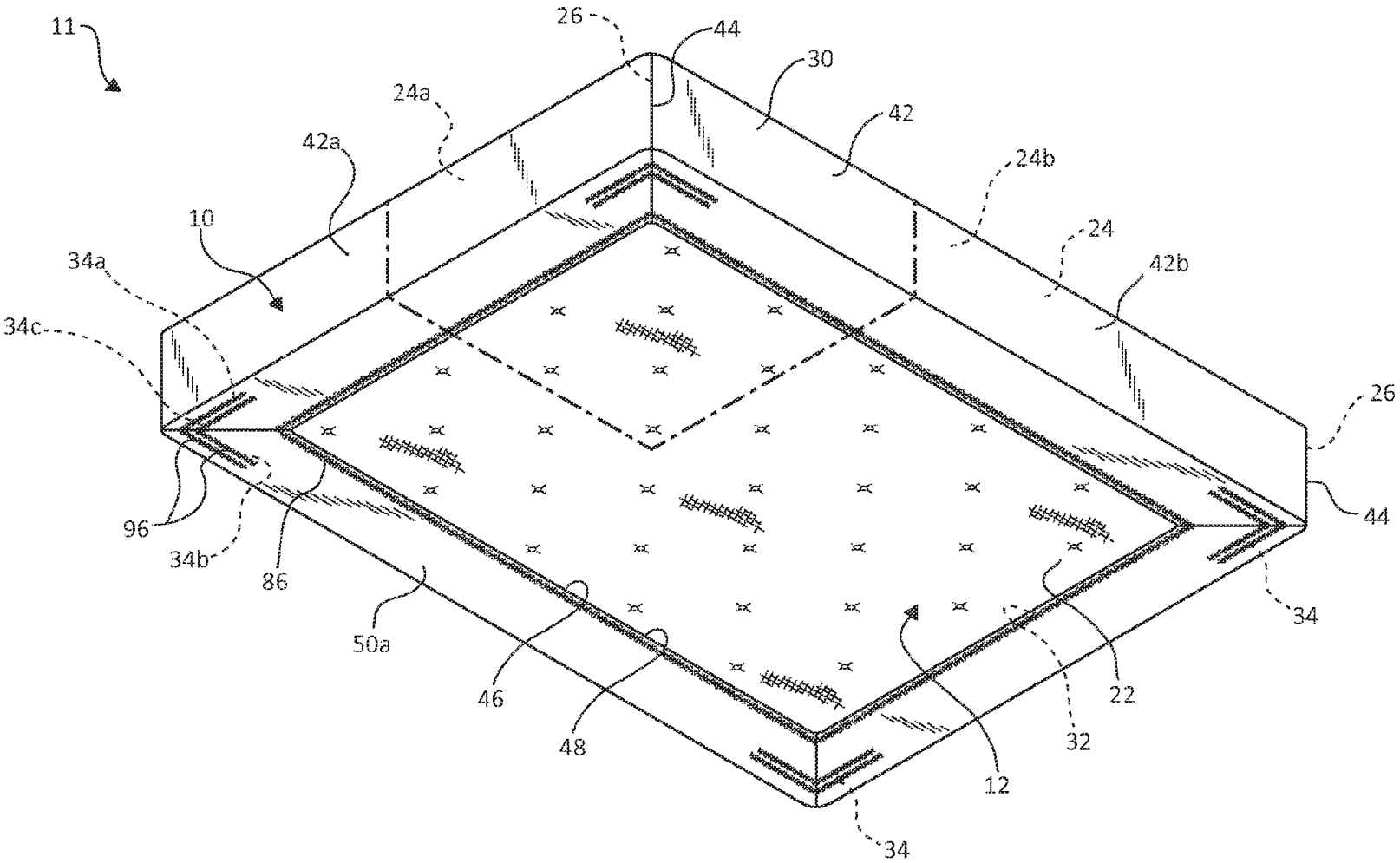
FIG. 2 is a bottom, front perspective view illustration of the covered mattress system of FIG. 1, according to one embodiment of the present invention.
Figure 3:
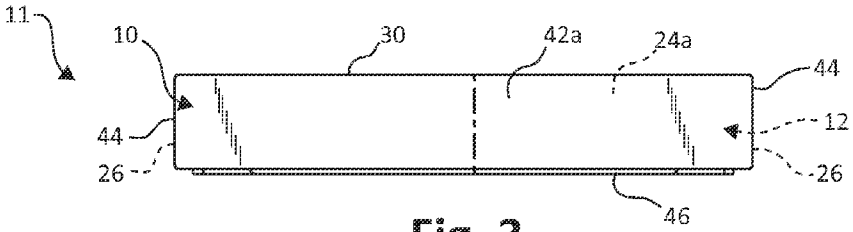
FIG. 3 is a front view illustration of the covered mattress system of FIG. 1, according to one embodiment of the present invention.
Figure 4:
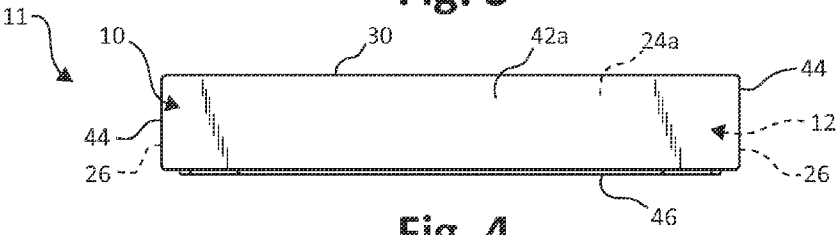
FIG. 4 is a rear view illustration of the covered mattress system of FIG. 1, according to one embodiment of the present invention.
Figure 5:
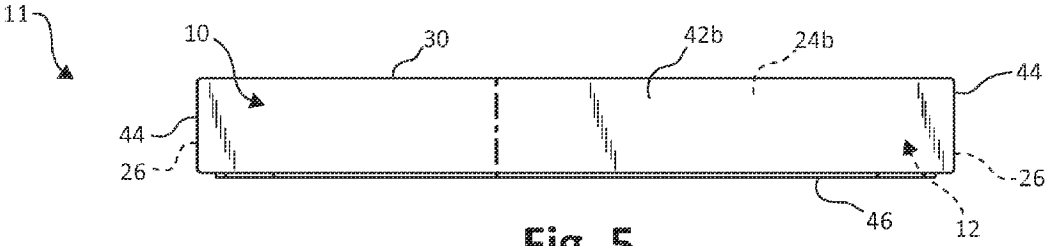
FIG. 5 is a right side view illustration of the covered mattress system of FIG. 1, according to one embodiment of the present invention.
Figure 6:
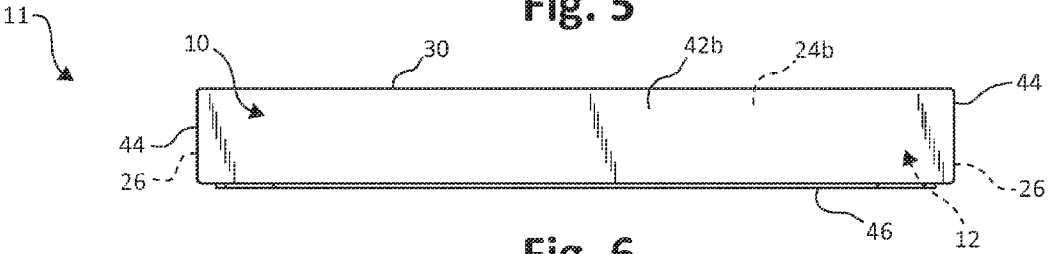
FIG. 6 is a left side view illustration of the covered mattress system of FIG. 1, according to one embodiment of the present invention.
Figure 7:
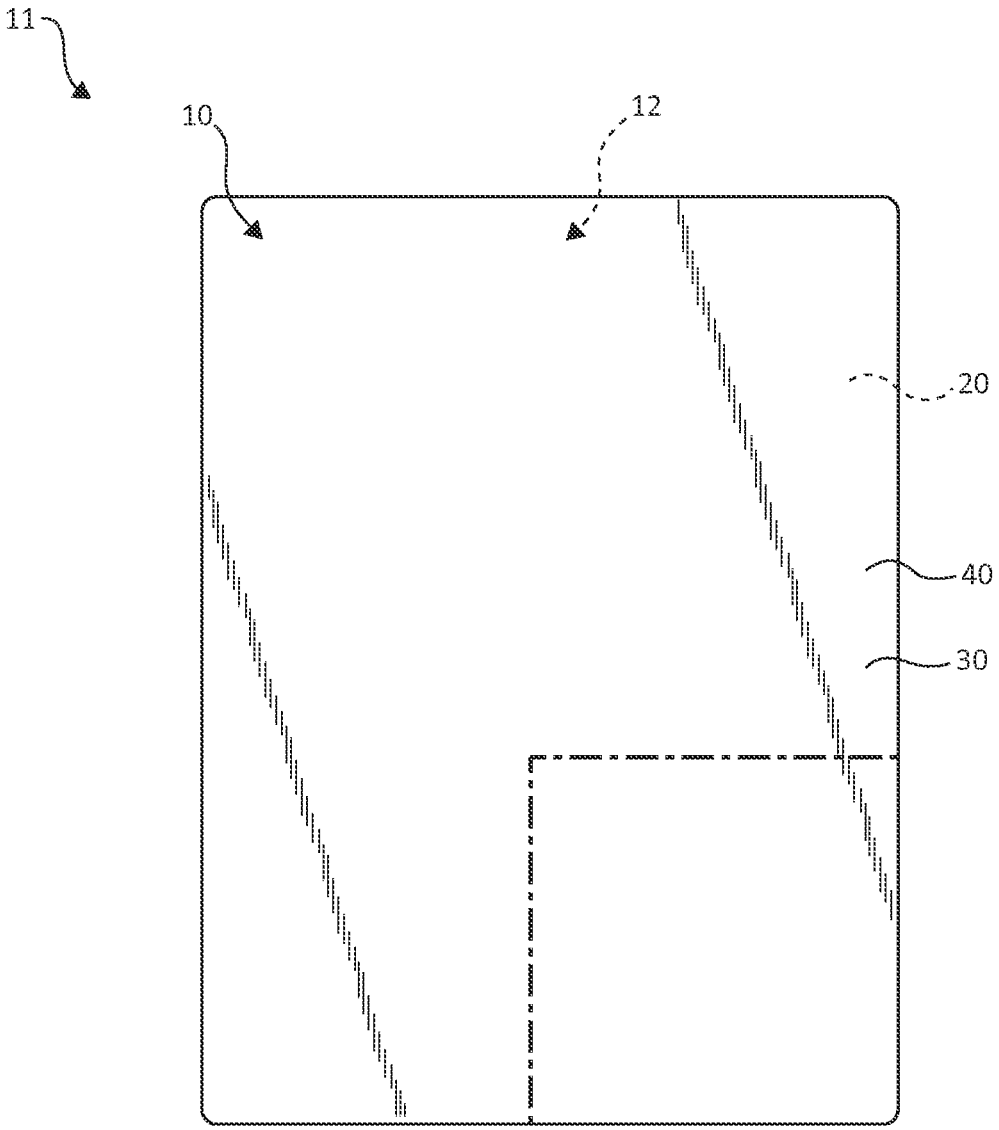
FIG. 7 is a top view illustration of the covered mattress system of FIG. 1, according to one embodiment of the present invention.
Figure 8:
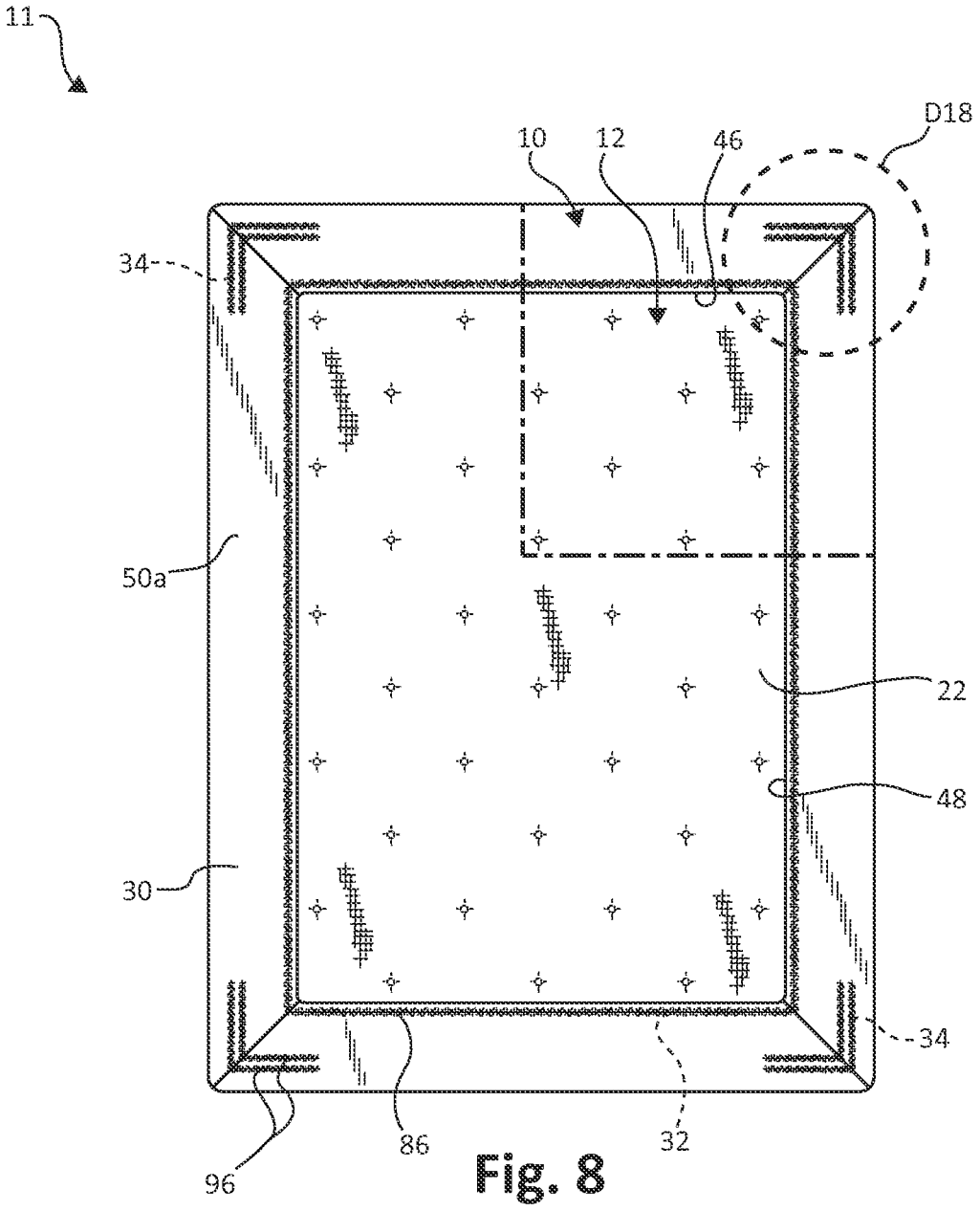
FIG. 8 is a bottom view illustration of the covered mattress system of FIG. 1, according to one embodiment of the present invention.
Figure 9:
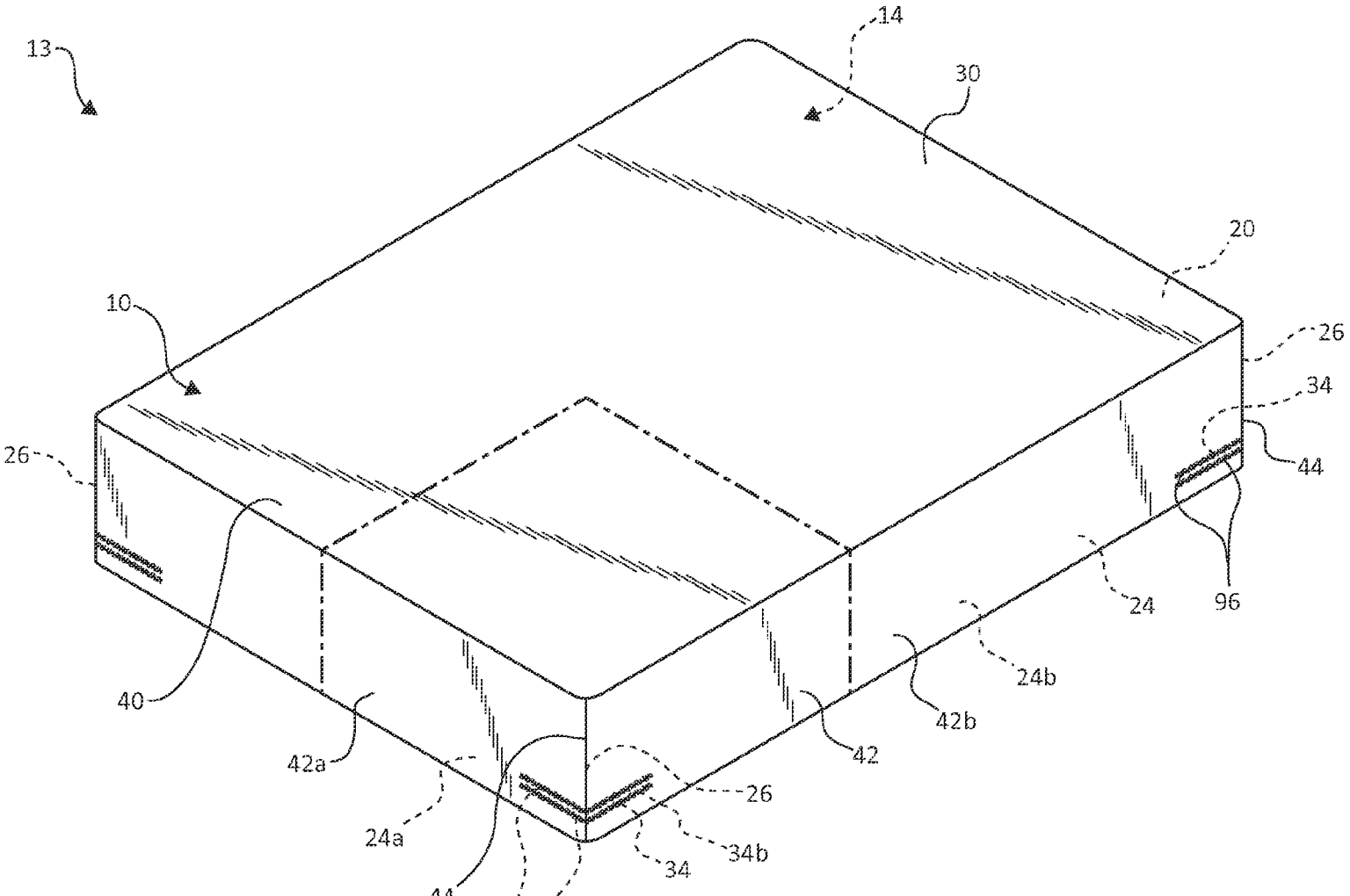
FIG. 9 is a top, front perspective view illustration of a covered mattress system, according to one embodiment of the present invention.
Figure 10:
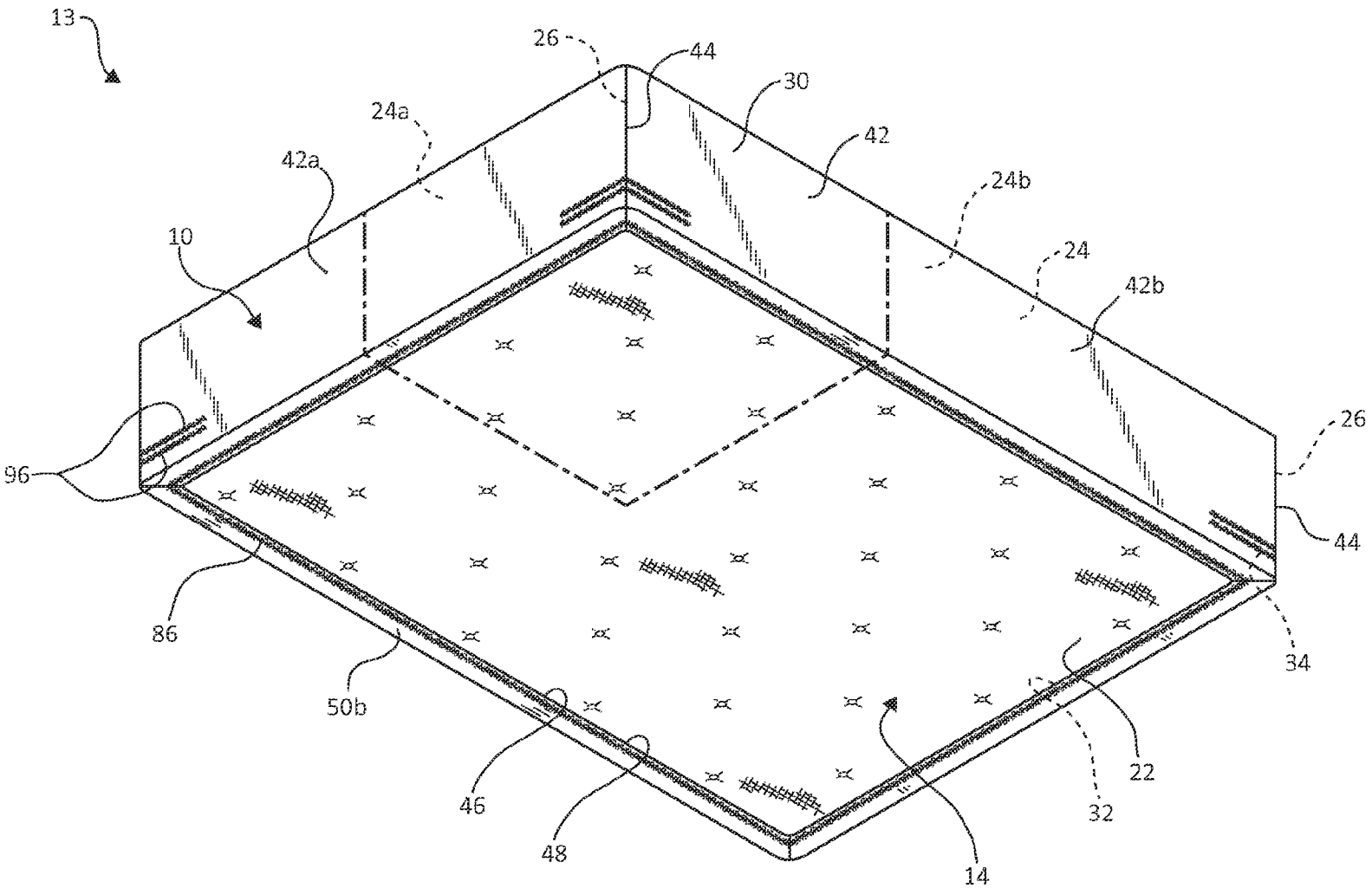
FIG. 10 is a bottom, front perspective view illustration of the covered mattress system of FIG. 9, according to one embodiment of the present invention.
Figure 11:
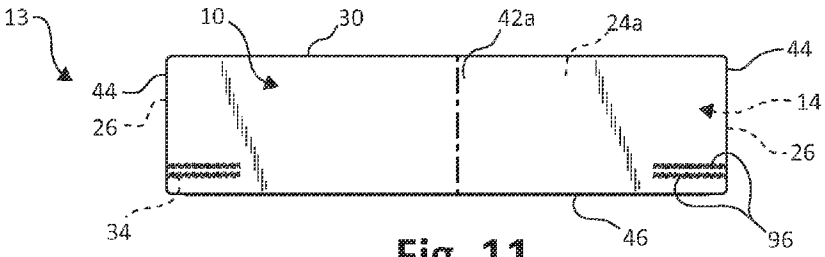
FIG. 11 is a front view illustration of the covered mattress system of FIG. 9, according to one embodiment of the present invention.
Figure 12:
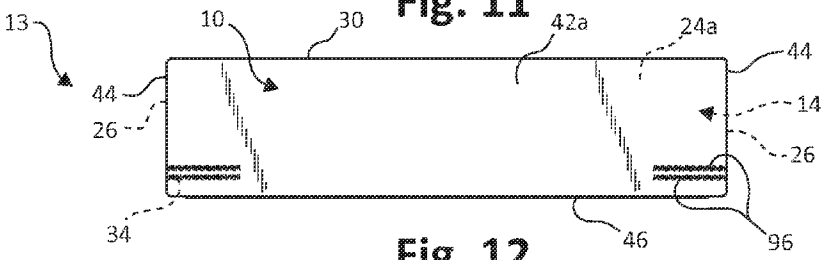
FIG. 12 is a rear view illustration of the covered mattress system of FIG. 9, according to one embodiment of the present invention.
Figure 13:
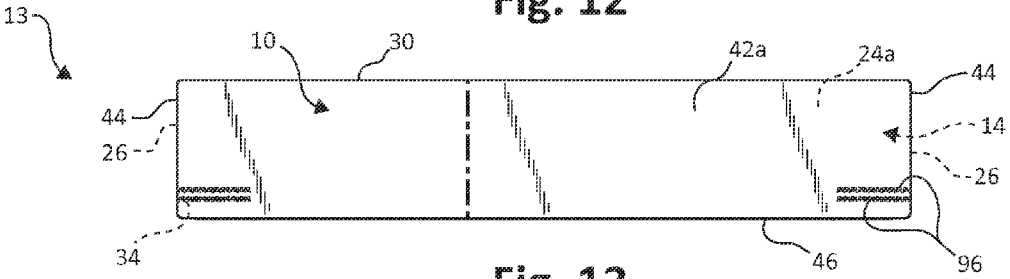
FIG. 13 is a right side view illustration of the covered mattress system of FIG. 9, according to one embodiment of the present invention.
Figure 14:
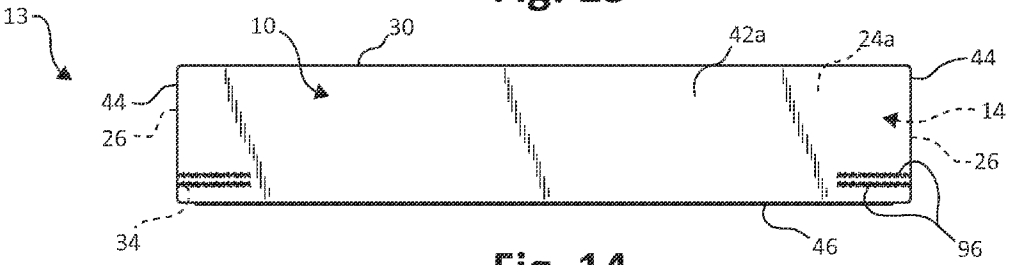
FIG. 14 is a left side view illustration of the covered mattress system of FIG. 9, according to one embodiment of the present invention.
Figure 15:
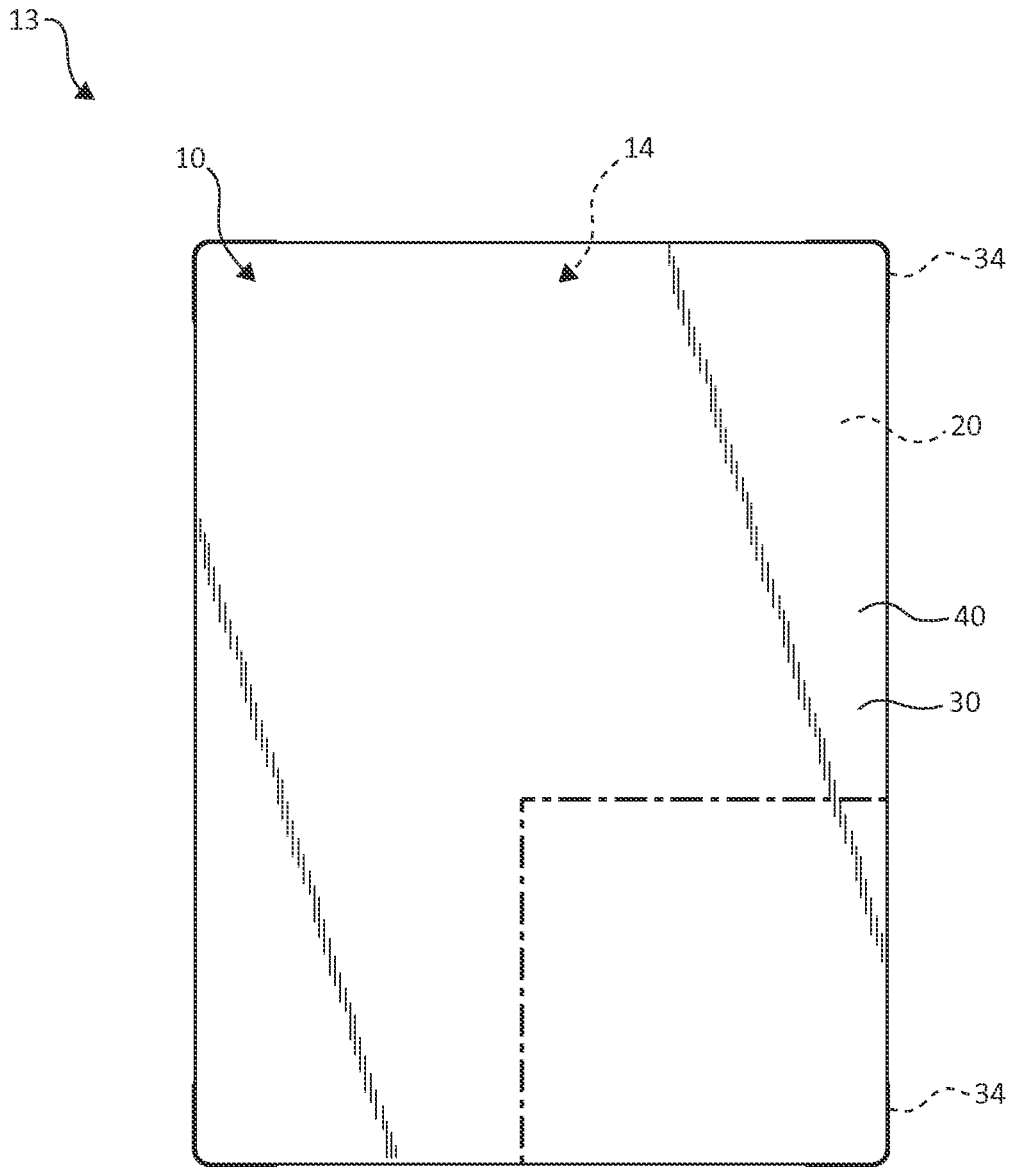
FIG. 15 is a top view illustration of the covered mattress system of FIG. 9, according to one embodiment of the present invention.
Figure 16:
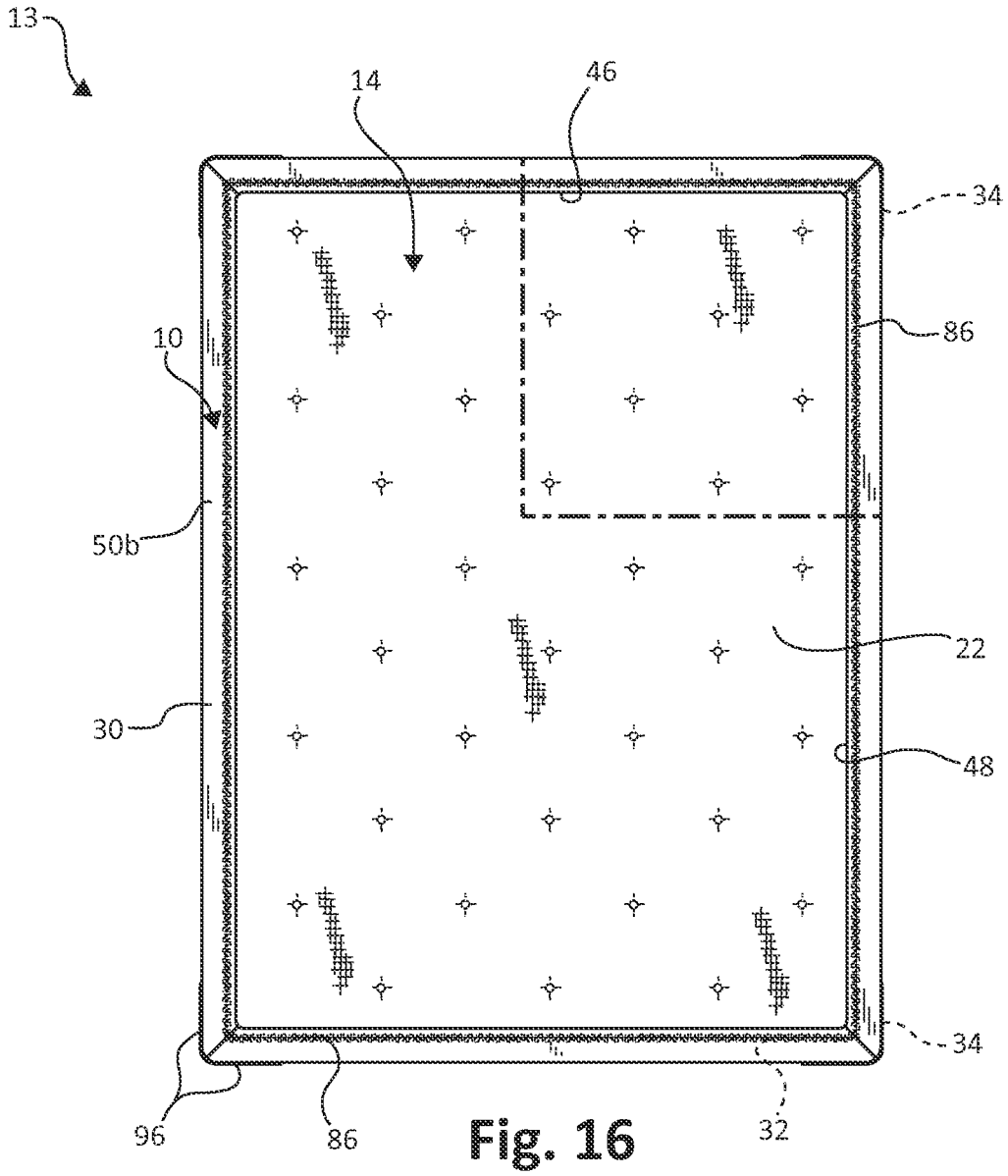
FIG. 16 is a bottom view illustration of the covered mattress system of FIG. 9, according to one embodiment of the present invention.

In one example, a straight or other suitable stitch 86 is sewn substantially parallel to fold line 66 on a side of fold line 66 nearer fold line 62 and through first, second, and third portions 70, 74, and 78 of each side panel 42 and through peripheral elastic band 32 forming closed loop binding 46 to maintain peripheral elastic band 32 therein around a substantial entirety of opening 48 (see, e.g., FIGS. 2 and 10). Notably, while one construction of closed loop binding 46 is illustrated and described in detail, one of ordinary skill in the art will recognize after reading this application that other constructions of closed loop binding 46 that provide for secure coupling with peripheral elastic band 32 can also be used. In one example, closed loop binding 46 is eliminated, and peripheral elastic band is sewn or otherwise secured directly to side panels 42 along their free edges 64.

Figure 22:
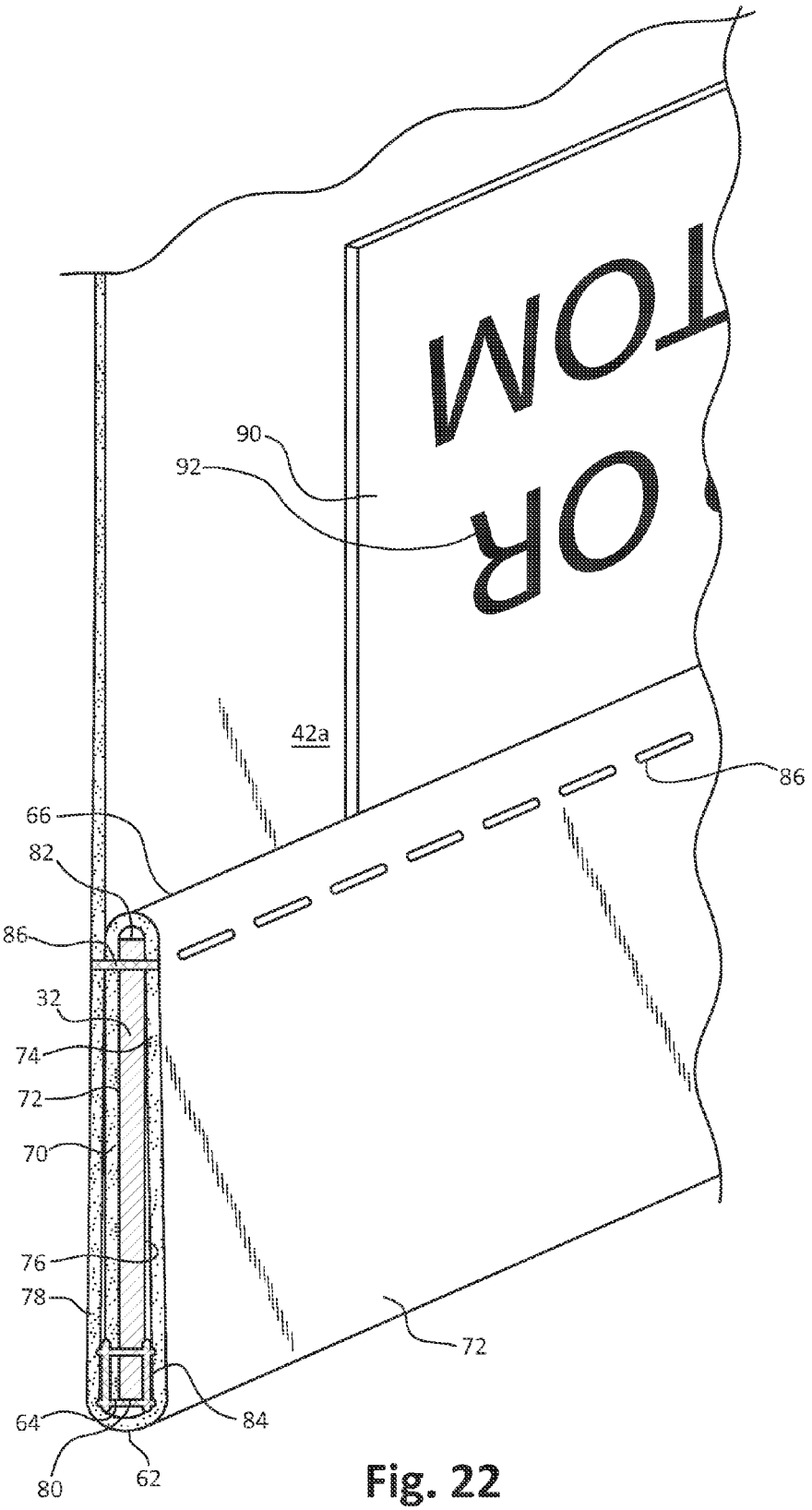
FIG. 22 is a cross-sectional, perspective view illustration of a lower peripheral edge of the fitted covering of FIG. 17, according to one embodiment of the present invention.
Figure 23:
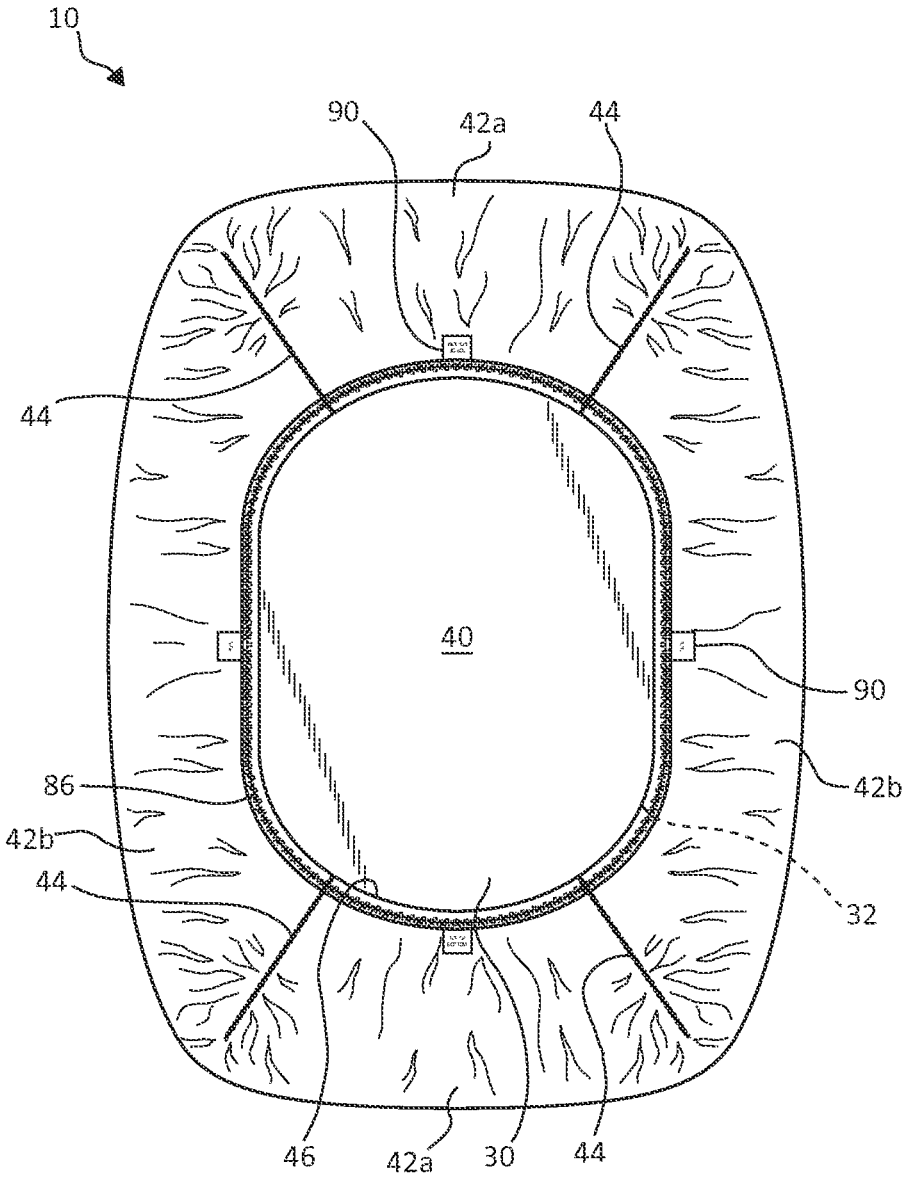
FIG. 23 is a bottom view illustration of the fitted covering of FIG. 17 turned to be inside out as compared with FIG. 17, according to one embodiment of the present invention.

In one embodiment, one or more labels 90 are also sewn into place via stitch 86 as best illustrated in FIGS. 22 and 23. In one example, each label 90 provides information regarding the proper orientation of the fitted covering 10 on a corresponding mattress including, for instance, indicia 92 such as "top or bottom" or "side" to facilitate a user in quickly aligning fitted covering 10 with the corresponding mattress.

At 212, corner elastic bands 34, for example, four corner elastic bands 34, are sewn or otherwise suitably coupled to body 30 of fitted covering 10, e.g., with stitching 96 on opposing edges thereof as generally illustrated in FIG. 18. Referring to the detailed corner view of FIG. 24, each corner elastic band 34 is placed to extend across a corresponding corner seam 44 such that first elastic band segment 34*a* extends from corner seam 44 and over a portion of lateral side panel 42*a* and second corner elastic band segment 34*b* extends from corner seam 44 over a portion of longitudinal side panel 42*b*. In the partially exploded view of FIG. 24, the final position of corner elastic band 34 is indicated by dashed line 88. In one embodiment, first elastic band segment 34*a* and second elastic band segment 34*b* each linearly extend in a different direction away from a center of the corresponding corner elastic band 34, for example, where the center of the corner elastic band 34 is coupled to the corresponding corner seam 44. In one embodiment, the center of the corner elastic band 34 secured to the corresponding corner seam 44 is positioned farther away from peripheral elastic band 32 than any other portion of the corner elastic band 34.

Corner elastic band 34 is positioned a distance X measured from a top end 94 of corner seam 44 adjacent upper panel 40 a distance in the middle range of available mattress depths. This distance X is consistent for all corner elastic bands 34 of fitted covering 10. For example in one embodiment, distance X is between about 9 inches and about 12 inches, for instance, about 10.5 inches. Any mattress having a thickness less than or equal to distance X will receive fitted covering 10 similar to first mattress 12 as illustrated in FIGS. 1-8 with corner elastic bands 34 being positioned adjacent lower face 22 of first mattress 12. Any mattress having a thickness greater than distance X will receive fitted covering 10 similar to second mattress 14 illustrated in FIGS. 9-16 with corner elastic bands 34 being positioned adjacent side faces 24 of second mattress 14. In one example each corner elastic band 34 is sized a length from end to end of less than one third the lateral dimension of upper panel 40. In one embodiment, corner elastic band 34 is about 12 inches in length. Accordingly, in one embodiment, each corner elastic band 34 only extends across a portion of the end quarter or less of each of the corresponding side panels 42.

Figure 17:
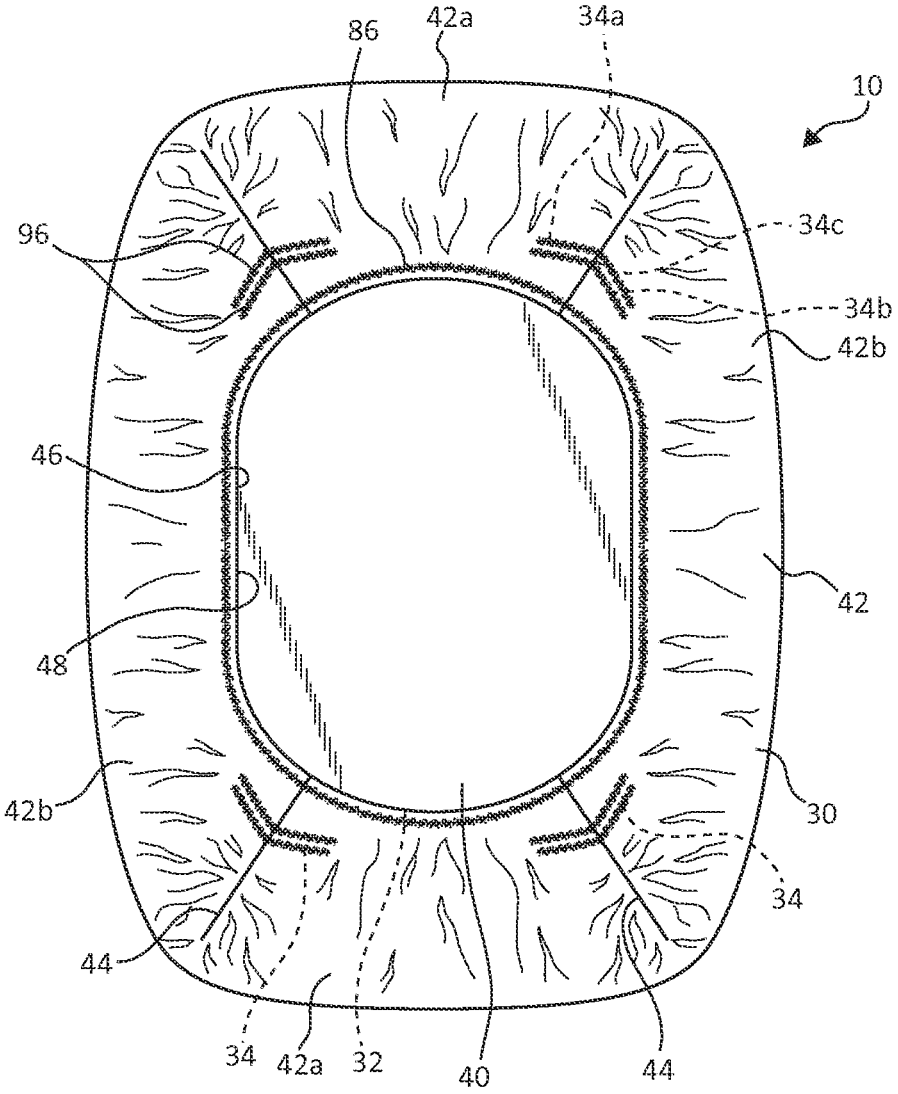
FIG. 17 is a bottom view illustration of a fitted covering for a mattress, according to one embodiment of the present invention.
Figure 24:
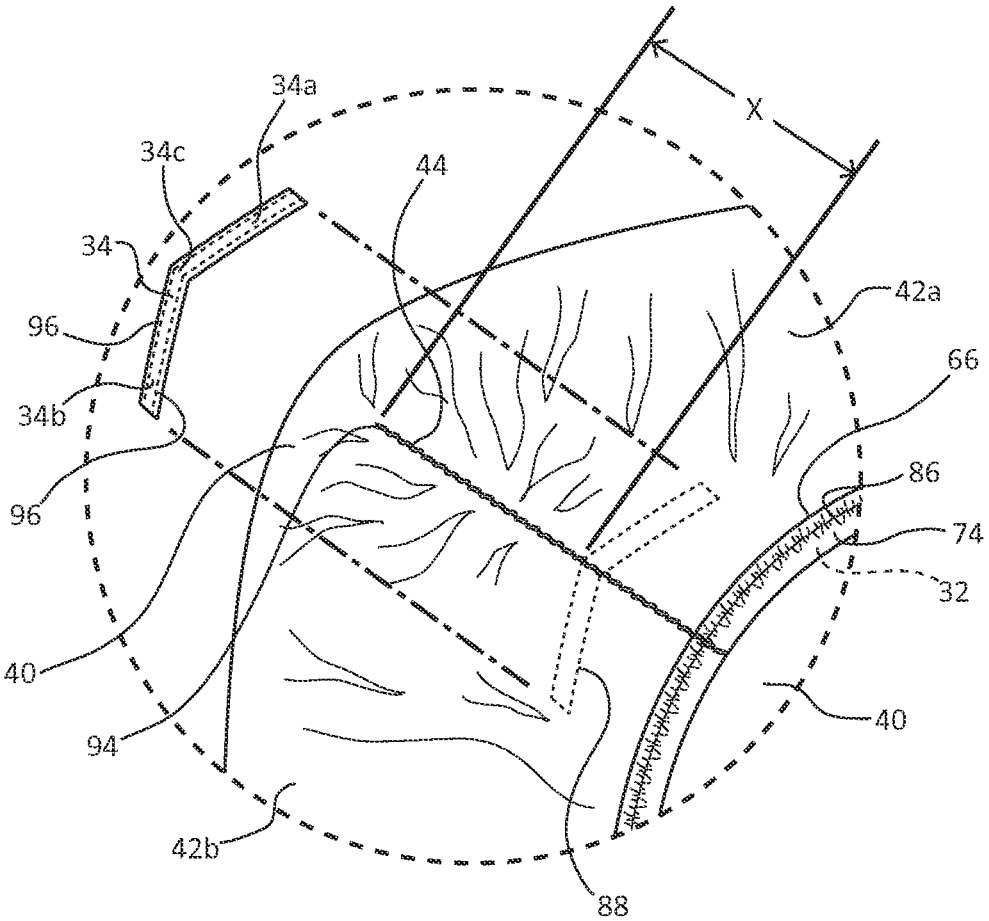
FIG. 24 is a detailed corner view illustration of the fitted covering of FIG. 24, according to one embodiment of the present invention.

In one example, when corner elastic bands 34 are positioned on un-stretched fitted covering 10 as shown in FIGS. 17, 23, and 24, each of first corner elastic band segment 34*a* and second corner elastic band segment 34*b* are angled or curved inwardly as they extend away from corner seam 44. In this manner, ends of corner elastic bands 34 opposite corner seam 44 are generally closer to closed loop binding 46 than center 34*c* of corner elastic band 34, which is secured to corner seam 44. This configuration provides extra tension to fitted covering 10 when it is placed over a mattress such that corner elastic bands 34 can be relatively short bands rather than longer bands that extend further away from corner seams 44 or use of a continuous, closed loop band extending between all corner seams 44 inset from closed loop binding 46. As such the present invention provides additional fitted covering 10 securement with a small amount of additional elastic and construction steps, providing an economical and efficient solution to prior fitted covering securement issues. In one embodiment, each corner elastic band 34 is secured to body 30 with two rows of stitching 96, such as straight stitching, one row near first elongated edge 80 and one row along second elongated edge 82 sewn while corner elastic band 34 is stretched. Such construction allows corner elastic bands 34 to pull body 30 tight along side panels 42 providing additional gripping around side faces 24 or lower face 24 of a corresponding mattress depending upon the particular thickness of the mattress. In one embodiment, following construction at 202, fitted covering 10 is packaged for sale and sold to end consumers for use.

At 204, a consumer uses fitted covering 10. More specifically, at 214, the consumer places fitted covering 10 on one of their mattresses (e.g., one of first mattress 12 and second mattress 14) by placing an internal surface of upper panel 40 adjacent or facing upper face 20 of their mattress. Side panels 42 of fitted covering 10 are stretched to extend down, around, and under side faces 24 of the mattress such that closed loop binding 46 with peripheral elastic band 32 are positioned under lower face 22 of the mattress. Placing fitted covering 10 on the mattress at 214 includes positioning corner elastic bands 34 relative to the mattress to additionally secure fitted covering 10 to the mattress at 216. As described above, depending upon the thickness of the mattress, corner elastic bands 34 are positioned to extend either along side faces 24 of the mattress (see, e.g., FIGS. 1-8) or below lower face 22 of the mattress (see, e.g., FIGS. 9-16). In either position, when placed on the mattress, corner elastic bands 34 stretch slightly and impart tension to fitted covering 10 between adjacent corner elastic bands 34 along each of side panels 42 to provide securement of fitted covering 10 to the mattress in addition of the peripheral elastic band 32.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. A fitted covering for a mattress, the fitted covering comprising:

a body including an upper panel and a side skirt extending outwardly away from the upper panel to define a free edge opposite the upper panel, wherein:

the upper panel defines corners, and the side skirt defines corner lines each extending away from one of the corners of the upper panel;

a peripheral elastic cord coupled to and extending substantially coextensively with the free edge; and corner elastic bands each formed separately and being spaced from one another, the corner elastic bands each extending substantially transversely across and being secured to a corresponding one of the corner lines of the side skirt, wherein each of the corner elastic bands is positioned nearer the peripheral elastic cord than the upper panel, each of the corner elastic bands includes opposing ends and a center positioned between the opposing ends, and the center of each of the corner elastic bands is secured to the corresponding one of the corner lines of the side skirt such that the center of each of the corresponding elastic bands is positioned farther away from the peripheral elastic cord than any other portion of the corner elastic band;

wherein:

the side skirt includes four side panels each extending from a different edge of the upper panel, and each of the four side panels is sewn to two adjacent others of the four side panels along the corner lines to form a corner seam extending along each corner line, and the four side panels collectively define the side skirt.

2. The fitted covering of claim 1, wherein:

each of the corner lines extends substantially linearly and substantially perpendicularly relative to the upper panel when the fitted covering is disposed on the mattress.

3. The fitted covering of claim 1, wherein each corner elastic band is secured to two of the four side panels adjacent the corresponding one of the corner lines of the skirt.

4. The fitted covering of claim 3, wherein each corner elastic band extends along a length of no more than a quarter of a length of each of the ones of the four side panels that is secured to the corner elastic band.

5. The fitted covering of claim 1, wherein each of the corner elastic bands curves inwardly as it extends away from the corner line.

6. The fitted covering of claim 1, wherein each of the corner elastic bands is secured to a length of the side skirt that is greater than a length of the respective one of the corner elastic bands in a non-stretched state.

7. The fitted covering of claim 1, wherein the body is formed as a single piece of material.

8. The fitted covering of claim 1, wherein the side skirt is substantially inelastic.

9. The fitted covering of claim 1, wherein the corner elastic bands are each positioned at least about 9 inches away from the upper panel.

10. The fitted covering of claim 1, in combination with a mattress including:

an upper face, a lower face opposite the upper face, and side faces extending between the upper face and the lower face, wherein:

the upper panel of the fitted covering extends over and substantially covers the upper face of the mattress, and the corner elastic bands of the fitted covering extend one of below the lower face of the mattress and along the side faces of the mattress depending upon a thickness of the mattress defined between the upper face and the lower face of the mattress.

11. The fitted covering of claim 1, wherein the fitted covering is one of a mattress pad and a fitted sheet.

12. The fitted covering of claim 1, wherein the corner elastic bands are each entirely positioned on the side skirt between the upper panel and the peripheral elastic cord.

13. The fitted covering of claim 1, wherein each of the corner elastic bands defines two opposing ends, and each of the corner elastic bands is substantially continuously stitched to the side skirt between corresponding ones of the two opposing ends.

14. The fitted covering of claim 1, wherein each of the corner elastic bands includes:

a first segment linearly extending from the center toward one of the opposing ends, and a second segment linearly extending from the center away from the first segment and toward the other of the opposing ends.

15. A fitted covering for a mattress, the fitted covering comprising:

a body including an upper panel and a side skirt extending outwardly away from the upper panel to define a free edge opposite the upper panel, wherein:

the upper panel defines corners, and the side skirt defines corner lines each extending away from one of the corners of the upper panel and includes four side panels each extending from a different edge of the upper panel between two adjacent ones of the corner lines;

a peripheral elastic cord coupled to and extending substantially coextensively with the free edge; and corner elastic bands each formed separately and spaced from one another, the corner elastic bands each extending substantially transversely across and being secured to a corresponding one of the corner lines of the side skirt and to two of the four side panels adjacent the corresponding one of the corner lines of the side skirt, wherein each of the corner elastic bands is positioned nearer the peripheral elastic cord than the upper panel, and each of the corner elastic bands linearly extends away from each side of the corresponding one of the corner lines to opposing ends of the corner elastic band and each of the corner elastic bands is positioned nearer the peripheral elastic cord at the opposing ends of each of the corner elastic bands than at the corner line.

16. The fitted covering of claim 5, wherein:

a curvature of each of the corner elastic bands toward the peripheral elastic cords at the ends of each of the corner elastic bands is more pronounced when the fitted covering is not disposed on the mattress as compared to when the fitted covering is disposed on the mattress.

17. A mattress covering for use on a mattress defining a top face, a bottom face positioned opposite the top face, and side faces extending substantially perpendicularly relative to the top face, the mattress covering comprising:

a body including:

a top panel for covering the top face of the mattress;

a side skirt for covering the side faces of the mattress and at least a portion of the bottom face of the mattress, wherein:

the side skirt includes two lateral skirt segments and two longitudinal skirt segments, and opposite ends of each of the two lateral skirt segments are positioned immediately adjacent to different ones of the two longitudinal skirt segments to form one of four intersection lines along a boundary between corresponding ones of the two lateral skirt segments and the two longitudinal skirt segments;

a closed-loop elastic band secured to edges of the side skirt opposite the top panel; and four separate corner elastic bands each extending across a different one of the four intersection lines, wherein each of the four separate corner elastic bands includes a lateral segment linearly extending from the different one of the four intersection lines over a portion of an adjacent one of the two lateral skirt segments toward another one of the four intersection lines and terminating at a first free end spaced from each of the two longitudinal skirt segments of the body;

wherein each of the four separate corner elastic bands is substantially entirely positioned over the side skirt between but spaced from each of the closed-loop elastic band and the top panel, and each of the four separate corner elastic bands is positioned nearer to the closed-loop elastic band at the first free end than at the different one of the four intersection lines.

18. The mattress covering of claim 17, wherein each of the four separate corner elastic bands includes a longitudinal segment extending from the different one of the four intersection lines over a portion of an adjacent one of the two longitudinal skirt segments toward a different one of the four intersection lines and terminating at a second free end spaced from each of the two lateral skirt segments of the body.

19. The mattress covering of claim 17, wherein the four separate corner elastic bands are entirely positioned over the side skirt between the top panel and the closed-loop elastic band and are positioned closer to the closed-loop elastic band than to the top panel of the body.

20. The mattress covering of claim 17, wherein the first free end of the each of the four separate elastic bands is positioned nearer the different one of the four intersection lines than to another one of the four separate elastic bands.

21. A method of constructing a fitted covering, the method comprising:

providing a fabric body including:

an upper panel defining four corners, a side skirt extending radially outwardly away from an outer periphery of the upper panel to define a free edge opposite the upper panel, the side skirt defining four panels, and each of the four panels extending between a different two of the four corners of the side skirt and defining a first end and a second end, wherein the side skirt defines corner lines each extending away from a different one of the corners of the upper panel along a substantially linear boundary between two of the four panels of the side skirt;

securing a primary elastic to the free edge such that the primary elastic extends substantially coextensively with the free edge; and securing secondary elastic bands, each formed separately from each other, to the side skirt entirely spaced from one another, wherein securing the secondary elastic bands includes:

positioning the secondary elastic bands to each extend substantially transversely across a corresponding one of the corner lines of the side skirt and to be positioned nearer the primary elastic than the upper panel, and securing a substantial entirety of a length of the secondary elastic bands to the side skirt such that each of the secondary elastic bands extends across the corresponding one of the corner lines, wherein securing the substantial entirety of the length of the secondary elastic bands includes securing each of the secondary elastic bands with two spaced rows of stitching, and each of the two spaced rows of stitching is adjacent a different one of opposing elongated edges of a corresponding one of the secondary elastic bands.

22. The method of claim 21, wherein positioning the secondary elastic bands includes placing a lateral segment of each one of the second elastic bands to extend across less than about 25% of a lateral width of one of the four panels of the side skirt.

23. The method of claim 21, wherein positioning the secondary elastic bands includes positioning each of the secondary elastic bands to curve inwardly toward the primary elastic as each of the secondary elastic bands extends away from the corner line such that each of the secondary elastic bands is positioned nearer the primary elastic at opposing ends of each of the secondary elastic bands than at the corner line, and a curvature of each of the secondary elastic bands toward the primary elastic at the ends of each of the secondary elastic bands is more pronounced when the fitted covering is not disposed on a mattress as compared to when the fitted covering is disposed on the mattress.

* * * * *